US009487271B2

(12) United States Patent
Craig

(10) Patent No.: US 9,487,271 B2
(45) Date of Patent: Nov. 8, 2016

(54) MODULAR BOAT LIFT COVER

(71) Applicant: Eric N Craig, Fort Meyers, FL (US)

(72) Inventor: Eric N Craig, Fort Meyers, FL (US)

( * ) Notice: Subject to any disclaimer, the term of this patent is extended or adjusted under 35 U.S.C. 154(b) by 0 days.

(21) Appl. No.: 14/996,614

(22) Filed: Jan. 15, 2016

(65) Prior Publication Data

US 2016/0129975 A1 May 12, 2016

Related U.S. Application Data

(63) Continuation-in-part of application No. 14/636,409, filed on Mar. 3, 2015, now Pat. No. 9,272,754.

(60) Provisional application No. 62/077,522, filed on Nov. 10, 2014.

(51) Int. Cl.

| | |
|---|---|
| ***E04H 15/36*** | (2006.01) |
| ***E04H 15/44*** | (2006.01) |
| ***B63B 17/02*** | (2006.01) |
| ***E04H 15/00*** | (2006.01) |
| ***E04H 15/18*** | (2006.01) |
| ***E04H 15/32*** | (2006.01) |
| *E04H 15/40* | (2006.01) |
| *B63C 3/00* | (2006.01) |

(52) U.S. Cl.

CPC ..... *B63B 17/02* (2013.01); *E04H 15/00* (2013.01); *E04H 15/18* (2013.01); *E04H 15/32* (2013.01); *E04H 15/36* (2013.01); *B63C 3/00* (2013.01); *E04H 15/40* (2013.01)

(58) Field of Classification Search

CPC ..... B63B 17/02; B63B 17/023; B63B 2017/026; E04B 1/32; E04B 1/3205; E04H 15/40; E04H 6/025

USPC ..... 114/361

See application file for complete search history.

(56) References Cited

U.S. PATENT DOCUMENTS

| | | | | | |
|---|---|---|---|---|---|
| 988,400 | A | | 4/1911 | Stonebridge | |
| 3,195,723 | A | | 7/1965 | MacDonnell et al. | |
| 4,091,584 | A | | 5/1978 | Brown | |
| 4,662,132 | A | | 5/1987 | Tennant | |
| 5,135,018 | A | | 8/1992 | Anderson | |
| 5,185,972 | A | | 2/1993 | Markiewicz | |
| 5,573,026 | A | * | 11/1996 | Griffith | E04H 15/18 114/361 |
| 5,730,281 | A | * | 3/1998 | Powell | B65D 5/5028 135/136 |
| 6,102,059 | A | * | 8/2000 | Miller | E04H 6/04 135/141 |
| 6,141,902 | A | * | 11/2000 | Boice | A01G 9/16 206/223 |
| 6,397,774 | B1 | | 6/2002 | Pranger | |
| 6,505,638 | B1 | * | 1/2003 | Powell | E04H 15/18 135/115 |
| 6,846,129 | B1 | | 1/2005 | Edson | |

(Continued)

*Primary Examiner* — Robert Canfield
(74) *Attorney, Agent, or Firm* — Gerald R. Black, Esq.

(57) ABSTRACT

The modular boat lift cover for a watercraft comprises a gable assembly and an adjustable support structure. All of the straight components are packaged into the main box frame channels for simplicity in packaging as well as quality control, ensuring no components are missing during packaging and shipping. The box frame channels have sufficient bulk to store the gable components during transport. The modular boat lift cover system has a robust, lightweight design that is compatible and adjustable for width, height and length as the boat owner modifies his existing boat or purchases a new boat, and that will protect the watercraft from the elements and will withstand even the severest of storms, undamaged as well as having the ability to be cantilevered. The modular boat lift cover is easy for the user to assemble and adjust on square lake style boat lifts, and the typically non-square tidal lifts.

20 Claims, 14 Drawing Sheets

(56) References Cited

U.S. PATENT DOCUMENTS 7,296,584 B2 * 11/2007 Goldwitz ..... E04H 15/44 135/121
7,353,769 B2 * 4/2008 Unrast ..... E04F 10/00 114/361
8,602,043 B2 * 12/2013 Kaiser ..... B63C 3/06 135/122
9,272,754 B1 * 3/2016 Craig ..... E04H 15/18
2004/0217030 A1 * 11/2004 Tseng ..... E04H 15/44 206/373
2005/0016438 A1 * 1/2005 Hey ..... B63C 5/00 114/361
2005/0207850 A1 * 9/2005 Suelzer ..... B63B 17/00 405/195.1
2005/0252542 A1 * 11/2005 Basta ..... E04H 15/34 135/156
2007/0295379 A1 * 12/2007 Basta ..... B63C 5/00 135/122
2011/0290292 A1 * 12/2011 Kaiser ..... B63C 3/06 135/96
2014/0026804 A1 * 1/2014 Templeton ..... B63B 17/02 114/361
2014/0093346 A1 * 4/2014 Kent ..... B63B 17/02 414/744.2
2014/0331569 A1 * 11/2014 Spearn ..... E04F 10/00 52/74
2015/0308143 A1 * 10/2015 Levin ..... E04H 15/48 135/121

* cited by examiner

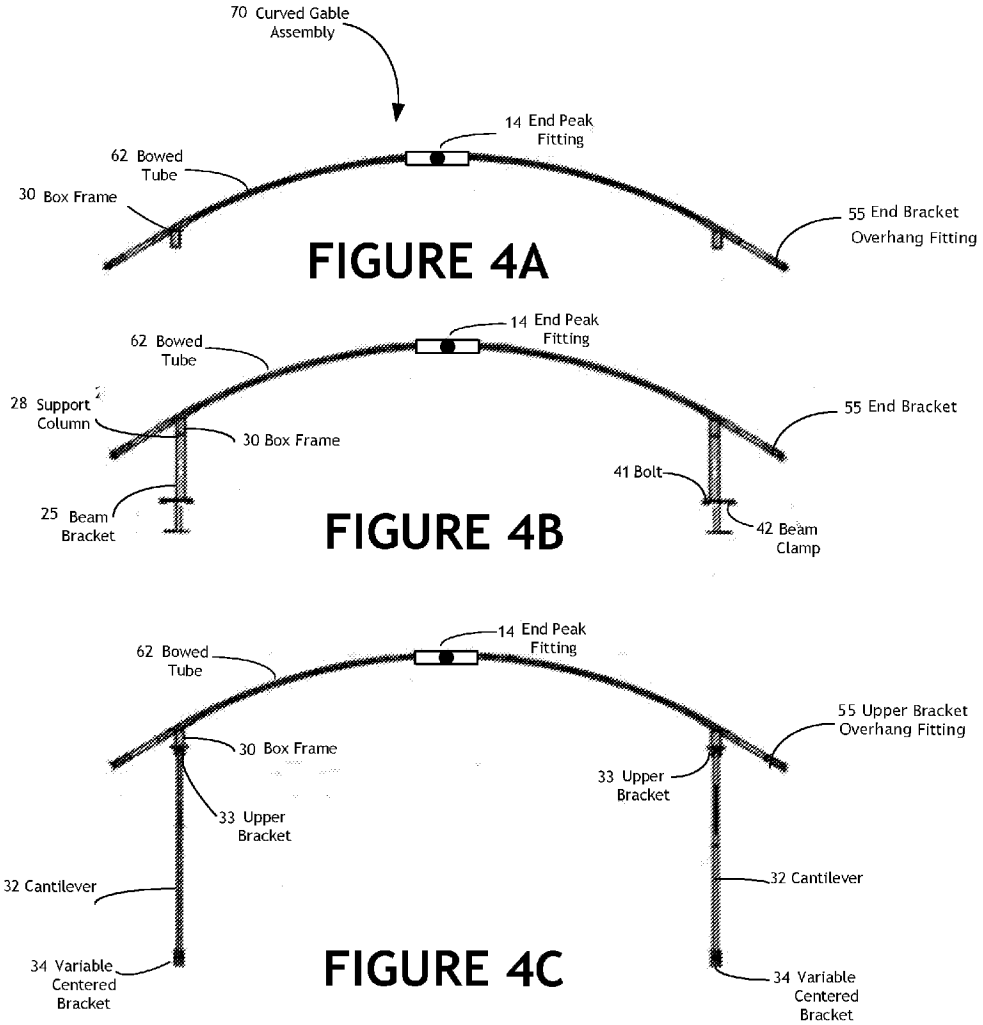
70 Curved Gable Assembly
14 End Peak Fitting
62 Bowed Tube
30 Box Frame
55 End Bracket Overhang Fitting
FIGURE 4A
14 End Peak Fitting
62 Bowed Tube
28 Support Column
30 Box Frame
25 Beam Bracket
41 Bolt
42 Beam Clamp
55 End Bracket
FIGURE 4B
14 End Peak Fitting
62 Bowed Tube
30 Box Frame
33 Upper Bracket
32 Cantilever
34 Variable Centered Bracket
33 Upper Bracket
55 Upper Bracket Overhang Fitting
32 Cantilever
34 Variable Centered Bracket
FIGURE 4C

MODULAR BOAT LIFT COVER

CROSS-REFERENCE TO RELATED APPLICATIONS

This Application is a Continuation-In-Part and claims priority to U.S. Provisional Application No. 62/077,522, entitled "Modular Boat Lift Cover," filed on Nov. 10, 2014; and U.S. patent application Ser. No. 14/636,409 entitled "Modular Boat Lift Cover," filed on Mar. 3, 2015.

FIELD OF USE

The present invention relates to a modular boat lift cover system which is designed for ease of shipping and assembly as well as adjustability as the lift owner changes or modifies their boat. The modular boat lift cover being unique in that it can accommodate all boat lifts that are square, such as lake lifts, as well as tidal lifts which, due to their nature of construction, are seldom square.

BACKGROUND OF THE INVENTION

A watercraft represents a significant investment. Watercraft owners' who store their boats on lifts understand that a boat lift cover or canopy is needed to minimize the maintenance work required to maintain the appearance of the boat. Watercraft owners need to shelter docked boats from the elements to preserve the life of the boat. While boat houses can provide such shelter, they are expensive, often impractical and, under some circumstances, not allowed by code. Watercraft owners also need to lift their watercraft out of the water for storage and maintenance, and to lower their watercraft into the water for launching or flotation at dock. There are typically two types of boat lifts: lake lifts and tidal lifts. A lake lift is typically manufactured as a complete frame system that is lowered into the water as a single unit and fastened to the lake floor. It remains square due to the calmness of inland water. Tidal lifts are typically constructed on site with a barge pounding long pilings into the sea floor onto which the boat lift mechanism is then mounted. This construction technique is subject to tidal forces during the time that the pilings are being hammered into the sea floor, which can cause the lift to be not perfectly square. Additionally, each boat lift manufacturer has its own design for the lifting I-beam, the cable system and the position of the electric motors making it difficult to design, manufacture and install a boat lift cover for tidal lifts.

Prior approaches use many different parts, while shipping in multiple boxes, or one large box. They also require complex assembly procedures and are not adjustable depending on the size of the watercraft.

U.S. Pat. No. 5,185,972 (Markiewicz) discloses an all-purpose modular canopy system including a canopy frame formed of a plurality of interconnected sections, the sections being formed of welded tubular elements. The sections are modular in configuration including end and central portions whereby the sections may be selectively assembled to produce the desired length. The canopy frame includes transversely disposed brace elements associated with supporting columns and adjustable fittings to facilitate alignment of the columns and canopy frame, and the canopy frame is covered by a flexible covering using a lacing system between the frame and covering to maintain covering tension. The covering may include a skirt cooperating with skirt stabilizers formed in the canopy frame corners for maintaining the skirt properly oriented.

U.S. Publication No. 20050252542 (Basta) discloses a boat lift canopy comprises a truss type framework with a base frame. Joined to the base frame and circumscribed by it is a tie tube frame, which may be discontinuous. A fabric cover, which in preferred embodiments is decorative as well as functional, snugly encloses the outside of the framework, wraps around the base frame and is secured to the tie tube frame.

U.S. Pat. No. 5,573,026 (Griffith) discloses a pre-fabricated boat lift canopy constructed of galvanized steel or aluminum tubing. All joints are crimped to a tight, permanent fit by using a special rolling tool. The canopy frame is mounted on "I" beams of existing boat lifts, docks, or pilings. The canopy frame is then covered with a water tight and sunlight resistant decorative canopy. Wind spoilers, in the form of canvas strips, are fastened to the peak of the canopy, a continuous strip, horizontally across the top, a strip at each end, and a third strip at the center.

U.S. Pat. No. 6,846,129 (Edson) discloses a boatlift assembly having a boat cradle portion and a canopy portion. The canopy portion and boat cradle portion are movably coupled to cause the canopy portion to be automatically raised when the boat cradle is lowered and to be automatically lowered when the boat cradle is raised.

U.S. Pat. No. 8,602,043 (Kaiser) discloses a wakeboard tower canopy which enables wakeboard boats which contain wakeboard towers of various height that protrude above the gunwale, sheer, and/or windshield of the wakeboard boat to gain protection against the elements. By constructing a special frame that incorporates a drive-through curtain system and also a peak in the canopy structure itself, the wakeboard boat being enabled to pull into the normal lift with enough clearance for the tower from the canopy frame.

The packaging of boat lift covers and canopies currently being marketed is overly-complicated and costly, and assembly is difficult to explain even with instructions. In order to communicate the intricacies of assembly and disassembly, personal demonstrations are often required. In some cases, multiple training sessions are needed. If the complicated unpacking was not difficult enough, the procedure for layout and assembly of the frame is oftentimes even more complex. In addition to the difficulty of assembly, current boat lift covers cannot be easily adjusted if the lift owner modifies his boat, such as by adding a tower, or replaces his boat with, for example, a larger boat. Current boat lift cover designs have some degree of adjustability but are not adjustable enough to easily accommodate all boat lift mechanisms and the dimensional tolerance variations of tidal lifts.

In addition, a further limitation of the prior art boat lift canopies, in general, is that they are not designed to maximize the structural inherent in truss type framework structures. Long unsupported overhangs, which are becoming increasingly popular, require that newer canopy configurations require considerable structural strength.

There is a need for a modular boat lift cover system that is easier to manufacture, package, assemble and disassemble. There is a need for a modular boat lift cover system that has a robust, lightweight design that is compatible and adjustable for width, height and length as the boat owner modifies his existing boat or purchases a new boat of different dimensions, and that will protect the watercraft from the elements and is designed to withstand even the severest of storms, undamaged. There is also a need for an adjustable boat lift cover that will work with any manufacturer's boat lift and will accommodate the variation in build tolerances of tidal lifts.

The is the primary object of boat lift cover of the present invention is to provide a modular boat lift cover that is comparatively simple to attach around the watercraft both in and outside the water and wherein attachment is possible and ensured that the boat lift cover will withstand even the severest of storms undamaged. It is an object of the present invention to provide a compact, all-weather, temporary shelter designed for both personnel and equipment. It is another object of the present invention to provide a modular boat lift cover that is easy to pack and assemble. All of the straight components are packaged into the main box frame channel for simplicity in packaging as well as quality control, ensuring no components are missing during packaging and shipping. It is yet another object of the present invention to provide a modular boat lift cover that is easy for the user to assemble and adjust, is intuitive and requires little training to adjust the canopy to different widths, lengths and heights both upon initial installation as well as during the life of the lift cover, enabling for the lift owner to accommodate modifications to his existing boat as well as to accommodate new boats of different dimensions. And, it is still yet another object of the present invention to provide a modular boat lift cover that is easy for the user to assemble and adjust, being compatible with square lake style boat lifts, as well as the typically non-square tidal lifts.

SUMMARY OF THE INVENTION

The modular boat lift cover of the present invention addresses these needs.

As used herein, a cantilever is a rigid structural element, such as a beam or a plate, anchored at only one end to a (usually vertical) support from which said cantilever is protruding. Cantilever construction enables overhanging structures without external bracing. Cantilever construction is in contrast to constructions supported at both ends with loads applied between the supports. When subjected to a structural load, the cantilever carries the load to the support where it is forced against by a moment and shear stress.

The modular boat lift cover of the present invention comprises a gable assembly of straight tubes, a canopy, a cantilever, and an adjustable support structure to accommodate the height of various watercraft.

The gable assembly includes a plurality of peak fittings, a plurality of box frame support members, a plurality of pipe fittings disposed on the box frame support members, and a plurality of tubes, which may be arcuate or straight, securely attaching the peak fittings to the box frame support members enabling for either a straight or curved roof design as well as no overhang or various lengths of overhang, depending on the customer's preference.

The modular boat lift cover of the present invention is preferably supported by a pair of cantilevers mounted on each by a bracket and secured to a box frame support member, said upper bracket being needed to support the gable assembly, which supports the canopy. It will be noted that the pair of cantilevers secured to each box frame support member are needed to support the modular boat lift cover of the present invention. The cantilevers in combination with the box frame channels have sufficient bulk to store the gable components during transport will protect the watercraft from the elements and withstand even the severest of storms, undamaged. The pair of cantilevers are secured to each box frame with an upper bracket and the pair of cantilevers are secured to the deck assembly with a variable centered bracket. The plurality of peak fittings are positioned on the gable assembly, the peak fittings being connected by at least one peak fitting connector tube.

The plurality of peak fittings are positioned between the box frames and a peak fitting connector tube of the gable assembly, the peak fitting connector tube being connected by at least one end peak fitting.

The plurality of box frame support members are preferably two parallel members, although other configurations are also envisioned. Preferably, the plurality of box support members is essentially parallel to the peak fitting connector tube. The peak fittings, the peak fitting connector tube, and additional connectors and fasteners can be stored inside the plurality of box frame support members during shipping. The box frame support members, including but not limited to standard square, rectangular, rhomboidal, trapezoidal, or other polygonal-shaped cross sectional shaped tubing, with either pointed or rounded edges, to round or oval cross sectional shaped tubing, being either regular or irregular in shape, the box frame support members having sufficient bulk to store members of the gable assembly during storage or transport.

The plurality of tubes are used as needed to attach the peak fittings to the box frame and to lay a foundation for the canopy. The plurality of tubes securely attach the peak fitting connectors to the box frame support members by engaging with the plurality of pipe fittings.

The canopy covers the gable assembly protecting the watercraft from the sun, rain and storms, the canopy being securely affixed to the gable assembly.

An adjustable support structure enables elevation and lowering of portions of the gable assembly of the modular boat lift cover of the present invention. The support structure is compatible with a wide variety of modular boat lift covers.

The gable assembly is supported upon the adjustable support structure which includes a plurality of beam brackets and a plurality of support columns, each support column being disposed within a beam bracket. The adjustable support structure provides a vertical adjustment for portions or all of the gable assembly. The gable assembly is cantilevered out from the support structure depending upon necessary clearance requirements for a particular length watercraft as well as depending upon the configuration of the main piles for the dock.

All of the length, width and height assemble points are designed to have a wide range of adjustment. This wide range of adjustment is what enables the modular boat lift cover of the present invention to accommodate boat lifts from any manufacturer as well as accommodating square lake lifts and out-of-square tidal lifts. In addition, the range of adjustment enables for easy configuration for different sizes of watercraft.

The modular boat lift cover of the present invention combines the advantages is a portable structure which in its collapsed state forms a standard shipping container for ease of transport.

The box frames of the modular boat lift cover of the present invention serves as shipping containers and modular building blocks for expanding the modular boat lift cover of the present invention to adapt to a completely different watercraft purchased by the owner.

For a complete understanding of the modular boat lift cover of the present invention, reference is made to the accompanying drawings and description in which the presently preferred embodiments of the invention are shown by way of example. As the invention may be embodied in many forms without departing from spirit of essential characteristics thereof, it is expressly understood that the drawings are for purposes of illustration and description only, and are not intended as a definition of the limits of the invention.

BRIEF DESCRIPTION OF THE DRAWINGS

FIG. 4A depicts an assembly end view of a gable assembly for the modular boat lift cover of FIG. 3.

FIG. 4B depicts a preferred embodiment of an end view of the curved gable assembly of FIG. 4A mounted on a pair of support columns and beam brackets.

FIG. 4C depicts a preferred embodiment of an end view of the curved gable assembly of FIG. 4A mounted on a pair of upper brackets, centered brackets and variable centered brackets.

DETAILED DESCRIPTION OF THE PREFERRED EMBODIMENTS

Figure 1:
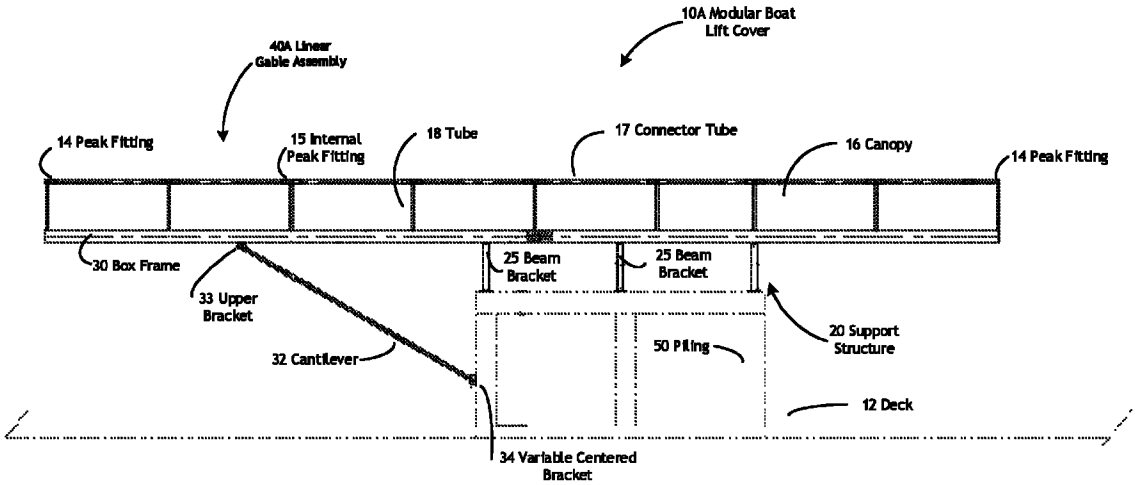
FIG. 1 depicts a first preferred embodiment of an assembly side view of the modular boat lift cover of the present invention, including the gable assembly, the support structure, and the cantilever attachment to the piling.

Referring now to the drawings, FIG. 1 depicts a preferred embodiment of an assembly side view of the modular boat lift cover of the present invention [10A]. The modular boat lift cover of the present invention [10A] comprises a gable assembly [13], a canopy [16], and an adjustable support structure [20] for a watercraft.

The gable assembly [13] includes a plurality of end peak fittings [14] and internal peak fittings [15], as further depicted in FIGS. 5A, 5B, 5C, 5D, a plurality of box frame support members [30], and a plurality of tubes [18] securely attaching the end peak fittings [14] and the internal peak fittings [15] to the box frame support members [30]. The box frame support members [30] are preferably horizontally mounted in the gable assembly [13] and cantilevered out from the piling [50] upon which the beam brackets [25] are attached if necessary for applications in which the piling [50] is not arrayed as desired for a given size boat or watercraft. In the cantilevered application, the cantilever [32] is not needed, or can be moved if required. The second box frame support members [30] are preferably horizontally disposed within said gable assembly [13].

Figure 9A:
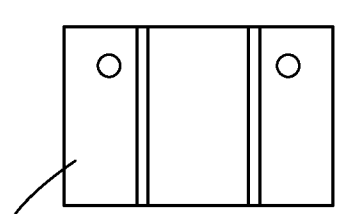
FIG. 9A depicts a preferred embodiment of the end view of the upper bracket for the centered bracket of FIG. 1.
Figure 9B:
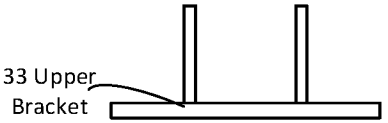
FIG. 9B depicts a preferred embodiment of the side view of the upper bracket for the centered bracket of FIG. 1.
Figure 9C:
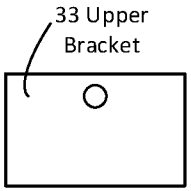
FIG. 9C depicts a preferred embodiment of the front view of the upper bracket for the centered bracket of FIG. 1.
Figure 10A:
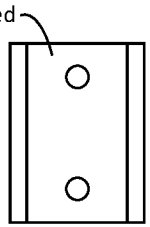
FIG. 10A depicts a preferred embodiment of the end view of the variable centered bracket for the centered bracket of FIG. 1.
Figure 10B:
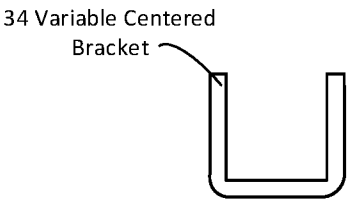
FIG. 10B depicts a preferred embodiment of the side view of the variable centered bracket for the centered bracket of FIG. 1.
Figure 10C:
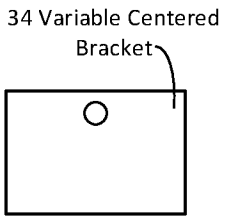
FIG. 10C depicts a preferred embodiment of the front view of the variable centered bracket for the centered bracket of FIG. 1.

As depicted in FIG. 1, the modular boat lift cover of the present invention [10A] is preferably supported by a pair of cantilevers [32] mounted on each by a bracket [33] and secured to a box frame support member [30], said upper bracket being needed to support the gable assembly [13], which supports the canopy. It will be noted that the pair of cantilevers secured to each box frame support member are needed to support the modular boat lift cover of the present invention [10A]. The cantilevers [32] in combination with the box frame channels [30] have sufficient bulk to store the gable components during transport will protect the watercraft from the elements and withstand even the severest of storms, undamaged. The pair of cantilevers [32] are secured to each box frame [30] with an upper bracket [33] (see FIGS. 9A, 9B and 9C) and the pair of cantilevers [32] are secured to the deck assembly [12] with a variable centered bracket [34] (see FIGS. 10A, 10B and 10C). The plurality of peak fittings [14 and 15] are positioned on the gable assembly [13], the peak fittings being connected by at least one peak fitting connector tube [17].

In cantilevered applications, the beam is affixed on one end with the other end protruding outwardly. This type of construction is commonly found as an architectural feature in buildings as well as being commonly used in bridge applications. When subjected to a load, the load is transferred down the beam to the point where beam is supported during the moment of force and shear stress. This type of construction enables no external bracing in overhanging structures.

Cantilevers are good for use in applications for wide spans while not requiring a large number of support members. For example, by using the cantilever design in bridge construction, a bridge may span a wide area with a minimum number of supports needed as well as enabling the supports to be further apart, saving in construction costs, as well as easing the construction of the span. In the present application, cantilevering the box frame support members [30] enables for the boat lift cover of the present invention to be used in applications where there piles [50] are not spaced properly to enable for the boat lift cover of the present invention [10A and 10B] to be correctly mounted so as to cover the given boat or water craft. Also, if there is an instance of not having enough piles [50] necessary for the primary embodiment, the box frame support members may be cantilevered instead. This will also have the effect of enabling for a greater number of lengths of boat to be stored in boat slips which may be meant for shorter craft.

During construction, the boat lift cover of the present invention [10A and 10B] can be temporarily cantilevered until assembly is completely. Frequently, during constructions projects, the cantilever is used temporarily, such as when a bridge span is being constructed between supports.

In other applications, the cantilever is deployed for overhangs, such as in buildings in which the floors are cantilevered so as to provide space for pedestrians to walk at the street level, as well as having the added benefit of providing protection from rain and sun.

The plurality of box frame support members [30] are preferably two parallel members, although other configurations are also envisioned. Preferably, the box frame support members [30] are essentially parallel to the peak fitting connector tube [17]. The peak fittings [14 and 15], the peak fitting connector tube [17], tubes [18], and additional connectors and fasteners (not shown) can be stored inside the plurality of box frame support members [30] prior to assembly and during shipping. The box frame support members [30] can be of any shape, i.e. round, oval, hexagonal, triangular or of any shape which is required for a given application as required. The tubing [18] can be straight or pre-curved, with even the pre-curved tubing [18] being storable in the box tubing [30]. The tubes [18] may be pre-curved, or straight, while still fitting into the box frame support members [30] for storage and/or transport.

Tubes [18] are used as needed to attach the peak fitting connector tube [17] to the box frame support members [30] and to lay a foundation for the canopy [16]. The tubes [18] securely attach the peak fittings [14 and 15] and the peak fitting connector tube [17] to the box frame support members [30].

The canopy [16] covers the gable assembly [13] protecting the watercraft from the sun and rain. The canopy [16] is securely affixed to the gable assembly [13]. The canopy [16] can be of any fabric type material which has sufficient wind- and ultraviolet—(UV) resistant properties, with the preferred embodiment being vinyl for its durability and ease of maintenance.

The adjustable support structure [20] enables elevation and lowering of portions of the gable assembly [13] of the modular boat lift cover of the present invention [10A]. The adjustable support structure [20] is compatible with a wide variety of modular boat lift covers, and can be mounted on any type of boat lift.

Figure 2A:
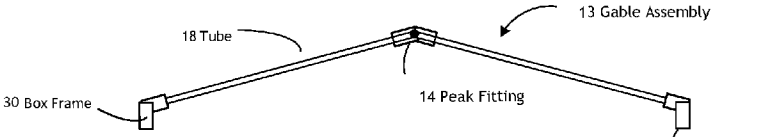
FIG. 2A depicts an assembly end view of the preferred embodiment of a gable assembly for the modular boat lift cover of the present invention of FIG. 1.
Figure 2B:
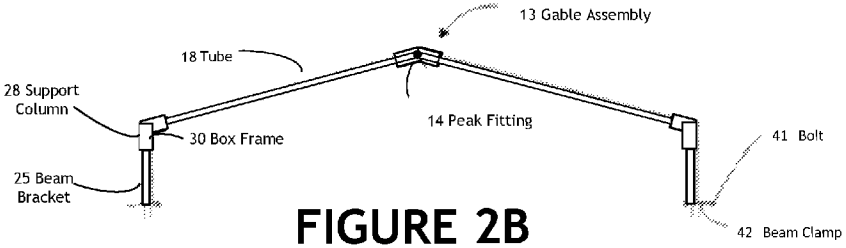
FIG. 2B depicts a preferred embodiment of an end view of the gable assembly of FIG. 1 mounted on a pair of support columns and beam brackets.

FIG. 2A depicts an assembly end view of a preferred embodiment of a gable assembly [13] for the modular boat lift cover of the present invention [10A]. FIG. 2B depicts a preferred embodiment of an end view of the gable assembly [13] of FIG. 2A mounted on an adjustable support structure [20]. The gable assembly [13] is supported upon the adjustable support structure [20] which includes a plurality of beam brackets [25] and a plurality of support columns [28], each support column [28] being disposed within a beam bracket [25]. The adjustable support structure [20] provides a vertical adjustment for portions or all of the gable assembly [13]. The adjustable support structure [20] enables the bow section of the gable assembly [13] to be raised or lowered, the stern section of the gable assembly [13] to be raised or lowered, or their combination to be raised or lowered. Similarly, the port and starboard sections of the gable assembly [13] can be raised or lowered. The preferred angle between the tubes [18] of the gable assembly [13] is 150°.

Figure 2C:
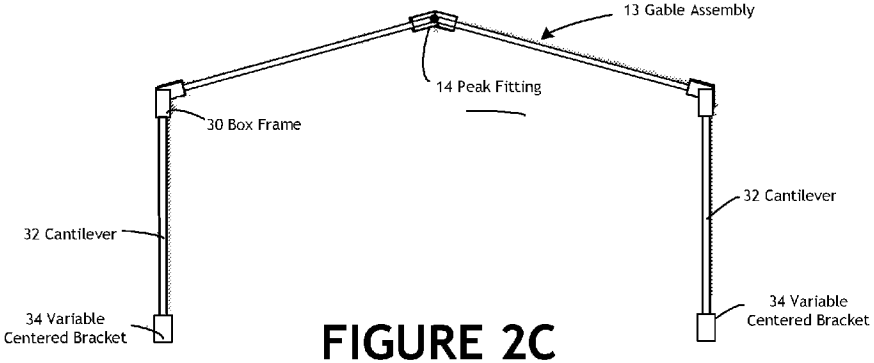
FIG. 2C depicts a preferred embodiment of an end view of the gable assembly of FIG. 1 mounted on a pair of upper brackets, centered brackets and variable centered brackets.

FIG. 2C depicts a preferred embodiment of an end view of the gable assembly [13] of FIG. 2A mounted on a pair of cantilevers [32] and variable centered brackets [34]. The cantilevers [32] are secured to the box frame support members [30] by a pair of upper brackets [33].

Figure 2D:
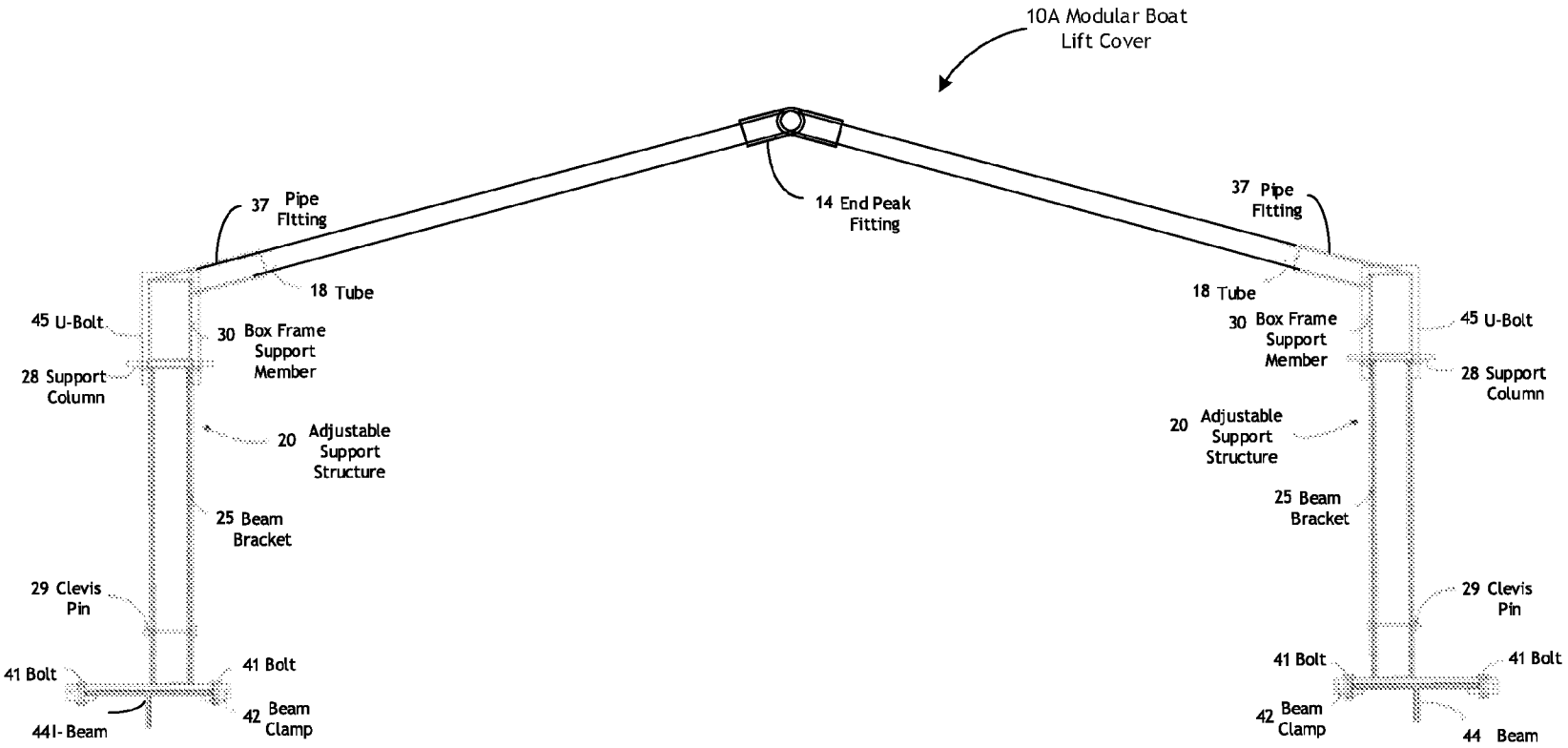
FIG. 2D depicts an exploded view of a preferred embodiment of an end view of the gable assembly of FIG. 1 attached to a pair of support columns with U-bolts, and a pair of beam brackets secured to I-beams with beam clamps.

FIG. 2D depicts an exploded view of a preferred embodiment of an end view of the gable assembly [13] and adjustable support structure [20] of FIG. 2B. Tubes [18] are inserted into the end peak fitting [14] and pipe fittings [37], which are in turn attached to the box frame support members [30]. The box frame support members [30] are fastened to the support columns [28] with U-bolts [45]. Each support column [28] is disposed within a beam bracket [25] and held in place with a clevis pin [29]. The clevis pin [29] can be removed to enable vertical adjustment of the support column [28] within the beam bracket [25]. The beam brackets [25] are in turn fastened to I-beams [44] of the deck assembly [12] using bolts [41] and beam clamps [42].

Figure 3:
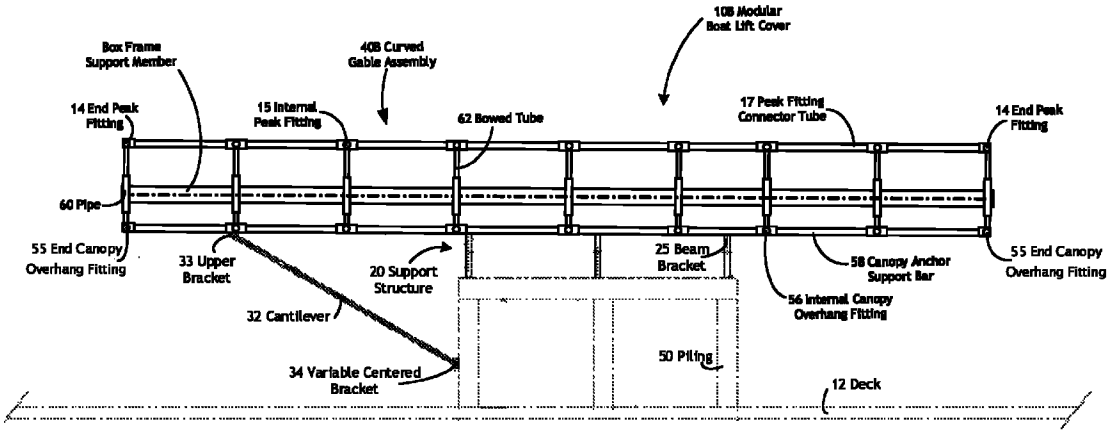
FIG. 3 depicts an assembly side view of a second preferred embodiment the modular boat lift cover of the present invention, the tube members being curved under stress, including the gable assembly, the support structure, and the cantilever attachment to the piling.

FIG. 3 depicts a preferred embodiment of an assembly side view of a curved gable assembly [70] of the modular boat lift cover of the present invention [10B].

The curved gable assembly [70] includes a plurality of end peak fittings [14] and internal peak fittings [15], as further depicted in FIGS. 5A, 5B, 5C, 5D, a plurality of box frame support members [30], and a plurality of bowed tubes [62] that are initially linear in shape but become bowed under stress are securely attaching the end peak fittings [14] and the internal peak fittings [15] to the box frame support members [30].

The plurality of peak fittings [14 and 15] are positioned on the curved gable assembly [70], the peak fittings being connected by at least one peak fitting connector tube [17].

The plurality of box frame support members [30] are preferably two parallel members, although other configurations are also envisioned. Preferably, the box frame support members [30] are essentially parallel to the peak fitting connector tube [17]. The peak fittings [14 and 15], the peak fitting connector tube [17], bowed tubes [62], and additional connectors and fasteners (not shown) can be stored inside the plurality of box frame support members [30] during shipping.

The bowed tubes [62] are used as needed to attach the peak fitting connector tube [17] to the box frame support members [30] and to lay a foundation for the canopy [16]. The bowed tubes [62] securely attach the peak fittings [14 and 15] and the peak fitting connector tube [17] to the box frame support members [30] using pipes [60] attached to the box frame support members [30].

An advantage of the curved gable assembly [70] is that it enables the creation of a canopy overhang on either side of the modular boat lift cover of the present invention [10B]. This enables additional protection of the watercraft from sun and rain and provides additional support during storms and high winds.

Figure 5A:
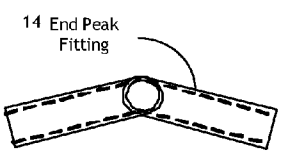
FIG. 5A depicts a preferred embodiment of the front view of the end peak fitting for the modular boat lift cover of FIGS. 1 and 3.
Figure 5B:
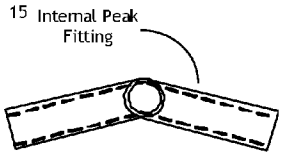
FIG. 5B depicts a preferred embodiment of the front view of the internal peak fitting for the modular boat lift cover of FIGS. 1 and 3.
Figure 5C:
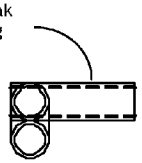
FIG. 5C depicts a preferred embodiment of the side view of the end peak fitting of FIG. 5A.
Figure 5D:
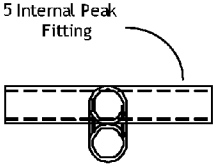
FIG. 5D depicts a preferred embodiment of the side view of the internal peak fitting of FIG. 5B.
Figure 5E:
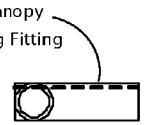
FIG. 5E depicts a preferred embodiment of the top view of the end overhang fitting for the modular boat lift cover of FIG. 3.
Figure 5F:
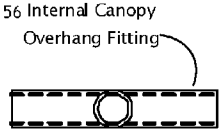
FIG. 5F depicts a preferred embodiment of the top view of the internal overhang fitting for the modular boat lift cover of FIG. 3.

The canopy overhang comprises a canopy anchor support bar [58] which is preferably parallel to the box frame support members [30] and the peak fitting connector tube [17]. The canopy anchor support bar is connected to the box frame support member [30] using a plurality of end canopy overhang fittings [55] and internal canopy overhang fittings [56], which are further depicted in FIGS. 5E and 5F.

The canopy overhang can be adjusted to suit the user's needs. For example, if the modular boat lift cover of the present invention [10A and 10B] is installed in an east-west orientation, there will be more exposure to the sun throughout the day on the southern side of the watercraft. The canopy overhang can be installed such that the side facing south is longer, thus providing more protection from the sun.

FIGS. 4A, 4B and 4C depict an assembly end view of a preferred embodiment of a curved gable assembly [70] for the modular boat lift cover of the present invention [10B], similar to FIGS. 2A, 2B and 2C, with the bowed tubes [62].

Figure 4D:
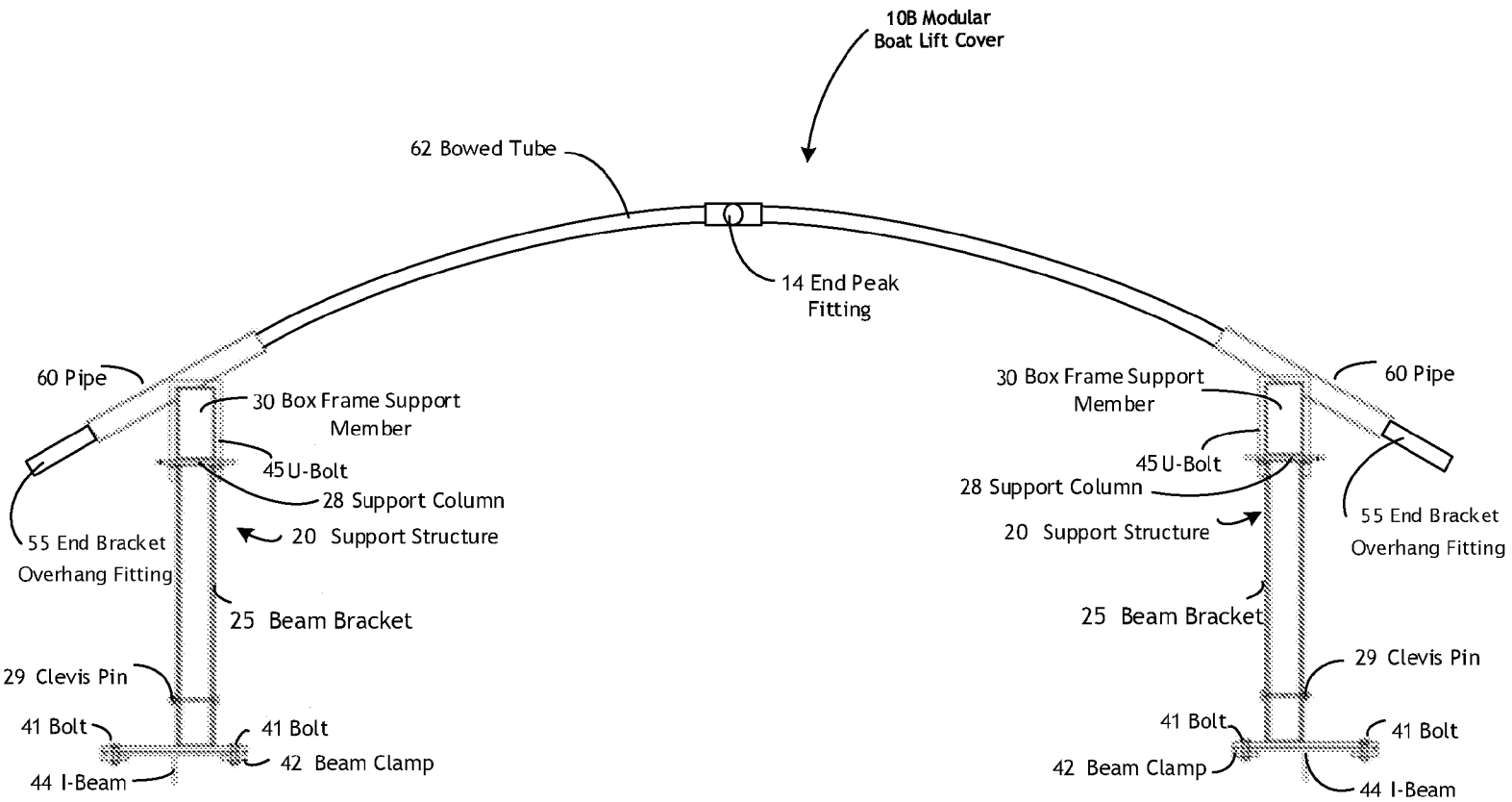
FIG. 4D depicts a preferred embodiment of an end view of the curved gable assembly of FIG. 4A attached to a pair of support columns with U-bolts, and a pair of beam brackets secured to I-beams with beam clamps.

FIG. 4D depicts an exploded view of a preferred embodiment of an end view of the curved gable assembly [70] and adjustable support structure [20] of FIG. 4B. The tubes [62] are inserted into the end peak fitting [14] and pipes [60], which are in turn attached to the box frame support members [30]. The box frame support members [30] are fastened to the support columns [28] with U-bolts [45]. Each support column [28] is disposed within a beam bracket [25] and held in place with a clevis pin [29]. The clevis pin [29] can be removed to enable vertical adjustment of the support column [28] within the beam bracket [25]. The beam brackets [25] are in turn fastened to I-beams [44] of the deck assembly [12] using bolts [41] and beam clamps [42].

Figure 6A:
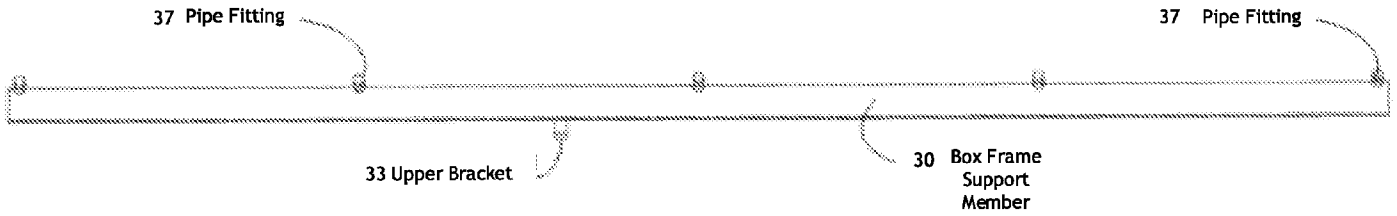
FIG. 6A depicts a preferred embodiment of a side view of the box frame of for the modular boat lift cover of FIG. 1.
Figure 6C:
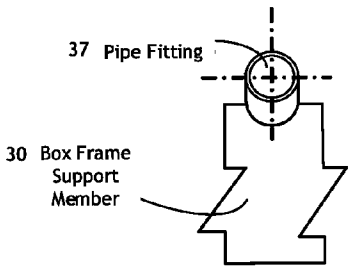
FIG. 6C depicts a preferred embodiment of a typical exploded front view of the box frame engagement with a pipe fitting of the gable assembly of the modular boat lift cover of FIGS. 2A, 2B and 2C.
Figure 6D:
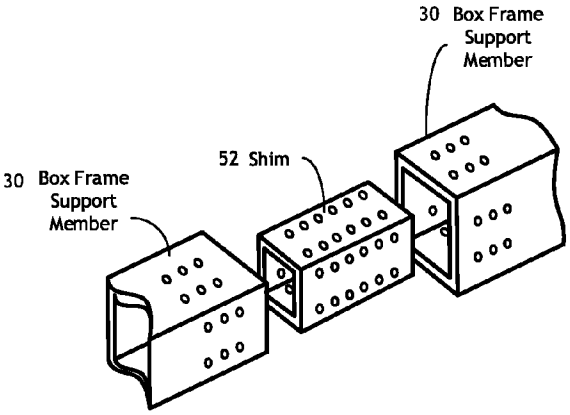
FIG. 6D depicts an isometric view of a preferred embodiment of the box frame splice assembly of the modular boat lift cover of FIG. 1.
Figure 6B:
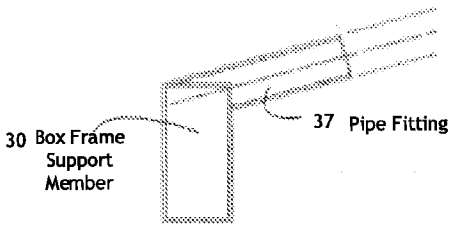
FIG. 6B depicts a preferred embodiment of a simplified end view of the box frame engagement with a pipe fitting of the gable assembly of the modular boat lift of FIGS. 2A, 2B and 2C.

FIG. 6A depicts the box frame support member [30] as well as pipe fittings [37] and the upper bracket [33]. FIG. 6B depicts an end view of the box frame support member [30] with the attached pipe fitting [37] and tube [18], which forms part of the gable assembly [13]. FIG. 6C depicts a side view of the box frame support member [30] with the attached pipe fitting [37]. FIG. 6D depicts an isometric view of two box frame support members [30] and a splice reinforcement [52], which is used for connecting the box frame support members [30] and strengthening the connection juncture. This enables the user to vary the length of the modular boat lift cover of the present invention [10A or 10B]. For smaller watercraft, the box frames [30] will not need to be spliced together in the gable assemblies, but rather a single box frame [30] on each side of the gable assemble will suffice. Only for larger watercraft, will multiple modular gable assemblies be needed, and the splice reinforcements [52] are needed to strengthen these junctures.

Figure 7A:
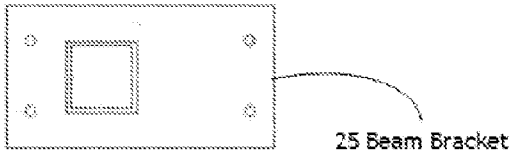
FIG. 7A depicts a preferred embodiment of a simplified top view of a beam bracket of the modular boat lift cover of FIGS. 1 and 3.
Figure 7B:
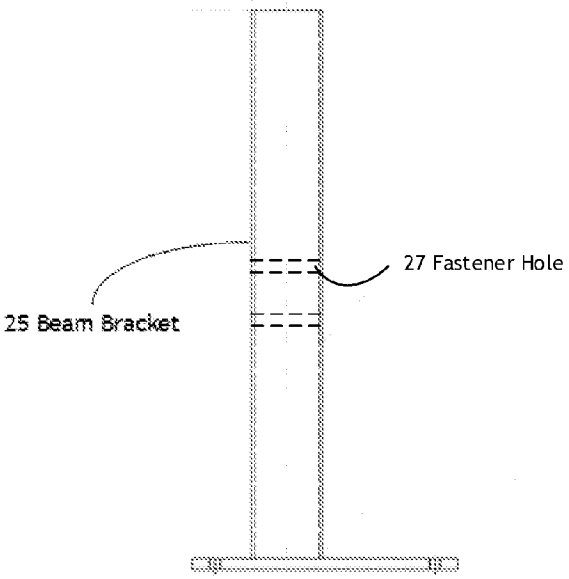
FIG. 7B depicts a preferred embodiment of a simplified side view of a beam bracket of the modular boat lift cover of FIGS. 1 and 3.
Figure 7C:
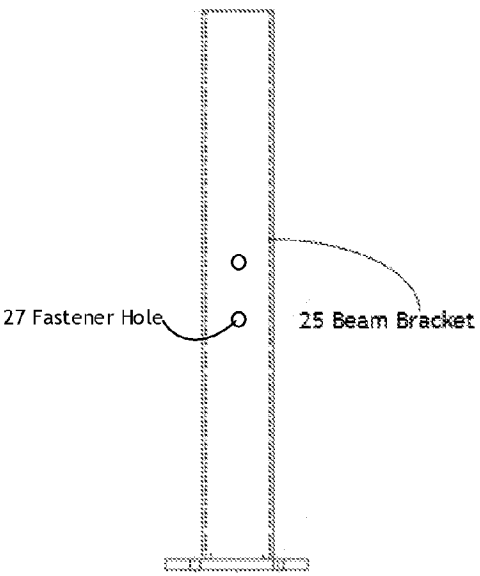
FIG. 7C depicts a preferred embodiment of a simplified front view of a beam bracket of the modular boat lift cover of FIGS. 1 and 3.

The preferred embodiment of the beam bracket [25] of the modular boat lift cover of the present invention [10A or 10B] is depicted in FIGS. 7A, 7B, and 7C. Holes [27] for the insertion of a clevis pin [29] are shown. The bottom plate is adjustable as after said bottom plate is secured to the beam bracket [25] excess may be cut off after mounting. The beam bracket [25] can be rotated 180°, on one side or both sides of the lift cover to enable for boat accessories such as outriggers or just to give additional protection from sunlight and rain.

In one preferred embodiment, the modular boat lift cover of the present invention [10A and 10B] features a top drive shaft used to raise and lower the boat. Box risers (not shown) may be used to provide raised attachment points for the beam brackets [25]. A box lift riser is attached to the boat lift frame on both sides of the drive shaft along the longitudinal axis. This enables normal functioning of the drive shaft with no interference from the beam brackets [25].

Figure 8A:
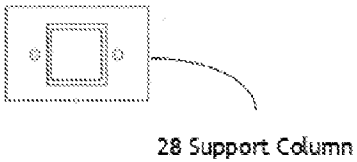
FIG. 8A depicts a preferred embodiment of a simplified top view of a support column of the modular boat lift cover of FIGS. 1 and 3.
Figure 8C:
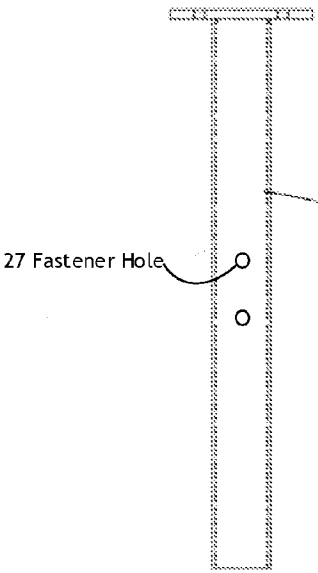
FIG. 8C depicts a preferred embodiment of a simplified front view of a support column of the modular boat lift cover of FIGS. 1 and 3.
Figure 8B:
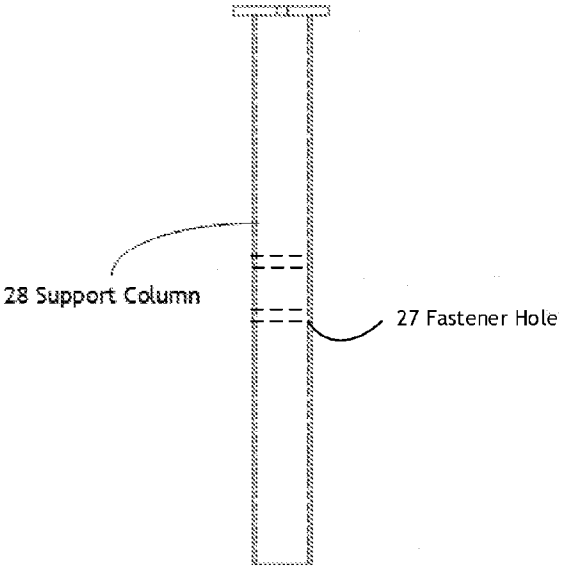
FIG. 8B depicts a preferred embodiment of a simplified side view of a support column of the modular boat lift cover of FIGS. 1 and 3.

The preferred embodiment of the support column [28] is depicted in FIGS. 8A, 8B, and 8C. The support column [28] is a bit smaller than the beam bracket [25] and fits inside the beam bracket [25]. A clevis pin [29] as shown in FIGS. 2D and 4D enables the relative height of the support column relative to the beam bracket [25] to be adjusted. Holes for the insertion of a clevis pin [29] are shown.

Figure 11:
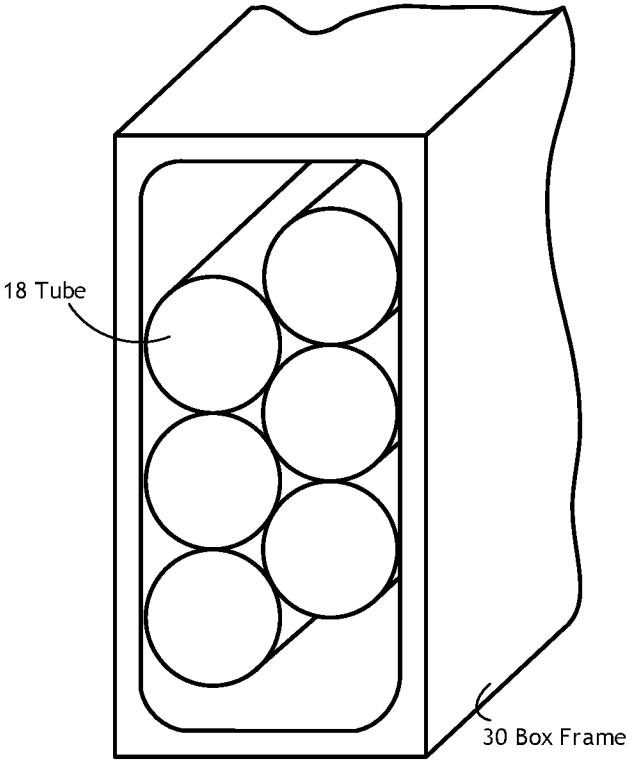
FIG. 11 depicts a plurality of tubes packaged inside a box frame of the gable assembly for the modular boat lift covers of FIGS. 1 and 3.

FIG. 11 depicts a plurality of tubes [18] packaged inside a box frame support member [30] of the gable assembly [13] for the modular boat lift cover of the present invention [10A and 10B]. This packaging method enables for ease of shipping, and ensures no parts are missing.

Figure 12:
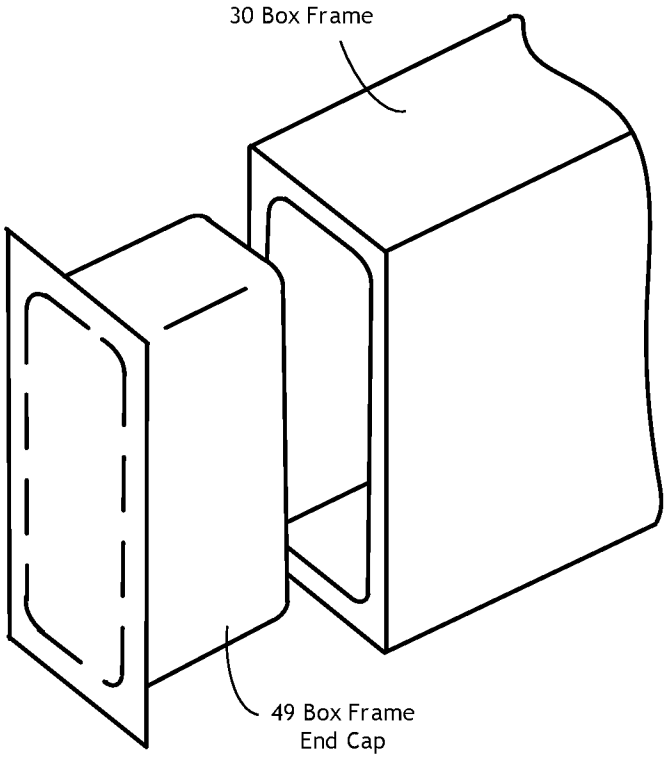
FIG. 12 depicts an isometric view of a preferred embodiment of the box frame end cap and box frame of the modular boat lift covers of FIGS. 1 and 3.

FIG. 12 depicts an isometric view of a preferred embodiment of the box frame end cap [49] and box frame support member [30] of the modular boat lift cover of the present invention [10A and 10B]. The box frame end cap [49] fits securely into one or both ends of a box frame support member [30] sealing said assembly. During shipping, the end caps [49] prevent the components stored therein from falling out. Once the modular boat lift cover of the present invention [10A and 10B] is installed by the user, the box frame end caps [49] seal the gable assembly and prevent debris and other material from entering the channel of the box frame support member or their combination [30].

Figure 13A:
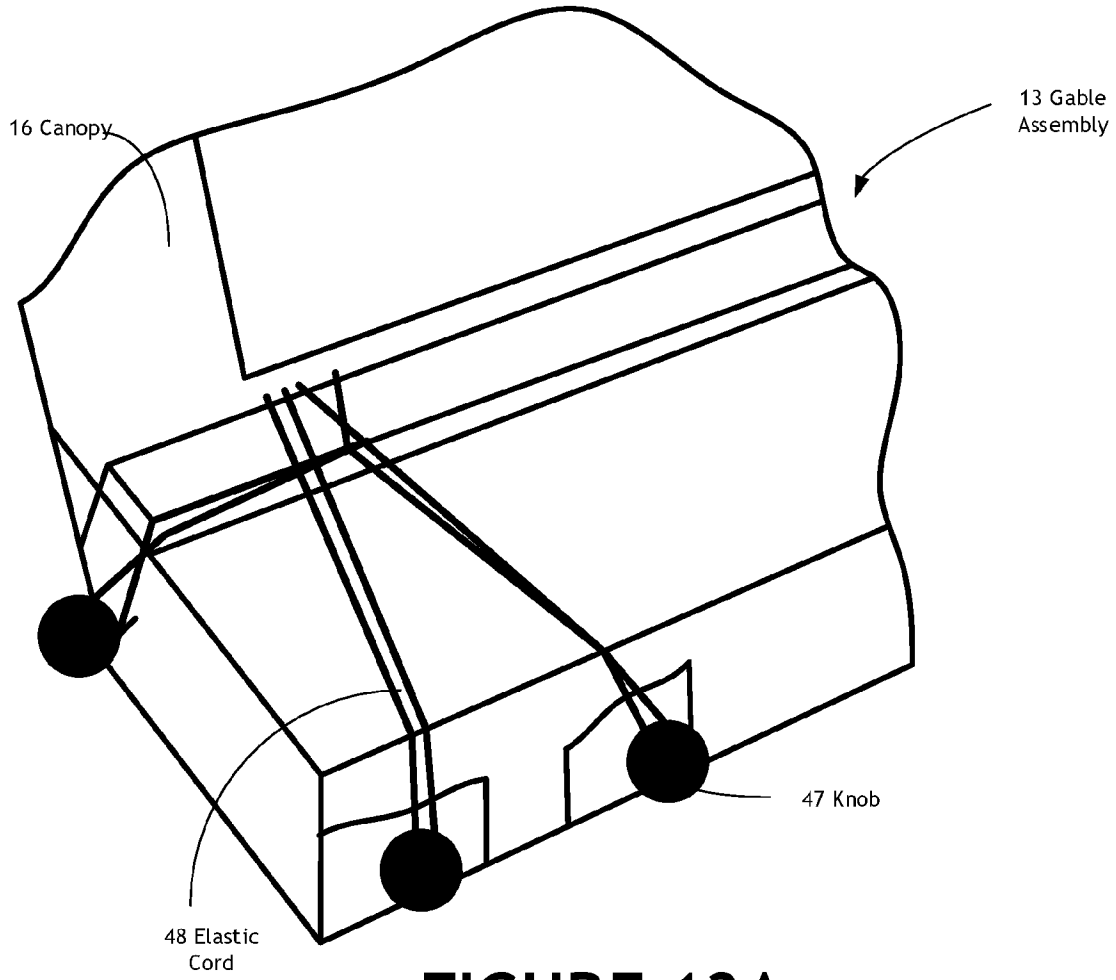
FIG. 13A depicts one preferred embodiment for attaching the canopy to the box frame of the boat lift cover of FIGS. 1 and 2A.

FIG. 13A depicts one preferred embodiment for attaching the canopy [16] to the gable assembly [13] of the modular boat lift cover of the present invention [10A and 10B]. Knobs [47] and elastic cords [48] are used to secure the canopy [16] in place. In a second preferred embodiment of the modular boat lift cover of the present invention, the canopy [16] is sold separately and is not included in the assembly.

The cantilever cover [16] is deployed in the modular boat lift cover of the present invention [10A and 10B] for use in covering and protecting a boat moored at a dock or slip, as the cover support and actuating mechanism may be secured to the side of the dock to extend over the boat to the open water side of the slip. It will also be seen that the cantilever cover may be used in other environments, e.g., as a patio cover, carport cover, etc., without a supporting structure opposite the laterally disposed actuating mechanism.

Figure 13B:
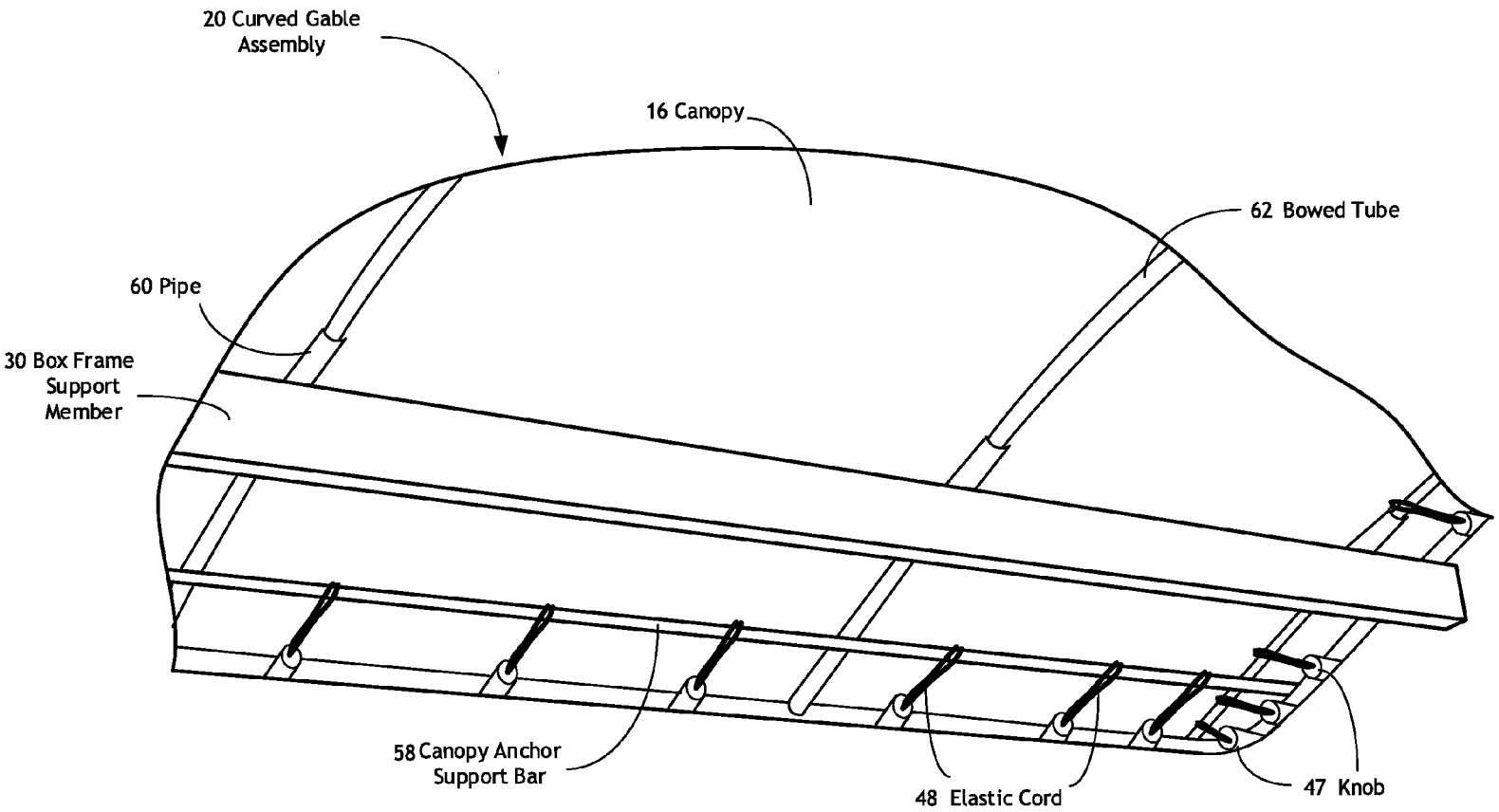
FIG. 13B depicts one preferred embodiment for attaching the canopy to the box frame of the boat lift cover of FIGS. 3 and 4A.

FIG. 13B depicts another view of a preferred embodiment for attaching the canopy [16] to the curved gable assembly [70] of the modular boat lift cover of the present invention. The canopy [16] is stretched over the curved tubes [62] which are inserted into the pipes [60]. The pipes [60] are attached to the box frame support member [30]. Knobs [47] and elastic cords [48] are used to secure the canopy [16] in place. The elastic cords [48] are attached to the canopy anchor support bar [58].

The modular boat lift cover of the present invention [10A and 10B] will be used on any boat lift and will replace the complicated current manufacturing process, complicated design, costly training of the sales force and installation teams, and will be stronger and last longer for the customer. This new design is a boat lift cover or canopy that is adjustable for width, height, length and placement on almost any boat lift.

The modular boat lift cover of the present invention [10A and 10B], preferably includes two 3 inch×6 inch aluminum box frame support members [30] with stainless steel connection bolts covered with a unique vinyl cover. The box frame support members [30], including but not limited to standard square, rectangular, rhomboidal, trapezoidal, or other polygonal-shaped cross sectional shaped tubing, with either pointed or rounded edges, to round or oval cross sectional shaped tubing, being either regular or irregular in shape, the box frame support members having sufficient bulk to store members of the gable assembly during storage or transport. This design has many fewer parts than current designs and will establish a new standard of strength and flexible and scalable design at a much lower cost. Significant cost savings will also be achieved with the tubes [18] fitting into the 3 inch×6 inch box frame support members [30]. In addition, customers will see a significant reduction in installation and service costs. This is only possible because of the simplicity in design and packaging. Also, there is a box frame end cap [49] which is included which covers the open end of the box frame support members [30] in order to prevent birds and other animals from taking up residence in the box frame support members [30].

Some of the many novel features of the modular boat lift cover of the present invention [10A and 10B] include that the modular boat lift cover [10A and 10B] is compatible with and will mount or fit on almost any boat lift, it is adjustable for the width, height and length of most any watercraft. Also, the tubes [18] and multiple gable components will fit into the box frame support members [30] for high density packaging, protecting the gable assembly [13] components, insuring that the kit is complete (no parts are missing), ease of assembly and significant cost savings both in the manufacturing process as well as the installation process. The modular boat lift cover of the present invention [10A and 10B] is also designed to survive wind speeds of greater than 150 miles per hour, or those found in a Category 5 hurricane. However, the vinyl cover must be and is easily removable by the modular boat lift cover of the present invention [10A and 10B] owner in event of a hurricane or other high winds.

Also, the modular boat lift cover of the present invention [10A and 10B] is designed to withstand winds of up to 180 miles per hour. The structural framing members have been designed in accordance with Florida Building Code Section 3105—Awnings and Canopies—specifically Section 3105.4.2.1 parts 1, 2 and 3, based on a rational analysis using Category 1 hurricane winds and exposure "D" corrosion. The design condition basis is a minimum wind gust velocity of 116 miles per hour (for 3 seconds) when the cover has been removed, and an ultimate sustained wind speed of 150 miles per hour. In the event of a hurricane, the owner will be able to quickly and easily remove the canopy [16].

All of the components of the gable assembly [13] will fit into the channel of one of the 3"×6" aluminum box frame support members [30], thereby improving quality control and packaging for the manufacturer, as well as giving the customer peace of mind knowing that everything will be in place without having multiple packages to deal with.

The preferred embodiment of the modular boat lift cover of the present invention [10A and 10B] uses aluminum construction in all materials to make the apparatus lighter and easier to use as well as corrosion resistant. However, other lightweight materials may also be used that are corrosion resistant and provide the unit with the necessary strength.

Accordingly, it will thus be seen from the foregoing description that the modular boat lift cover of the present invention [10A and 10B] along with the accompanying drawings provides a new and useful modular gable assembly that is expandable and readily modifiable to adapt to changes in the watercraft. In addition, the modular boat lift cover of the present invention [10A and 10B] can be deployed with a different watercraft having desired advantages and characteristics, enabling the owner of the watercraft to deploy the modular boat lift cover of the present invention [10A and 10B] as a building block to accommodate other watercraft that he or she may subsequently acquire.

Throughout this application, various Patents and Applications are referenced by number and inventor. The disclosures of these documents in their entireties are hereby incorporated by reference into this specification in order to more fully describe the state of the art to which this invention pertains.

It is evident that many alternatives, modifications, and variations of the adjustable modular boat lift cover of the present invention will be apparent to those skilled in the art in light of the disclosure herein. For example, the system can be used for all types of boat lifts as well as other applications, such as a portable event tent. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

PARTS LIST

10A. Modular Boat Lift Cover (with linear tubes)

10B. Modular Boat Lift Cover (with linear tubes that become arcuate when stressed)

12. Deck Assembly

13. Gable Assembly
14. End Peak Fitting
15. Internal Peak Fitting
16. Canopy
17. Peak Fitting Connector Tube
18. Tube
20. Adjustable Support Structure
25. Beam Bracket
27. Fastener Hole
28. Support Column
29. Clevis Pin
30. Box Frame Support Member
32. Cantilever
33. Upper Bracket
34. Variable Centered Bracket
37. Pipe Fitting
40A. Curved Gable Assembly
40B. Curved Gable Assembly
41. Bolt
42. Beam Clamp
44. I-Beam
45. U-Bolt
47. Knob
48. Elastic Cords
49. Box Frame End Cap
50. Piling
52. Splice
55. End Canopy Overhang Fitting
56. Internal Canopy Overhang Fitting
58. Canopy Anchor Support Bar
60. Pipe
62. Bowed Tube

I claim:

1. A modular boat lift cover for a first watercraft, said modular boat lift cover comprising:
- a gable assembly including;
  - a plurality of peak fittings including two end peak fittings sandwiched about at least one internal peak fitting, said plurality of peak fittings being positioned on a peak of said gable assembly;
  - a plurality of support tubes being initially linear in shape but becoming bowed under stress, one of said plurality of support tubes being securely attachable to one of said plurality of peak fittings; and
  - a first and a second box frame support member each supporting at least one of said plurality of support tubes, said first box frame support member being horizontally disposed, said plurality of support tubes being positionable inside said first box frame support member during shipping; and
- a cantilever bracing said gable assembly to a piling, said piling being a substantially vertical support disposed between a support structure and a waterway bottom.

2. The modular boat lift cover of claim 1, further comprising an end cap securely disposed nestably inside a first end of said first box frame support member, said end cap preventing debris from entering said first end of said first box frame support member when said end cap is disposed relative to said first end of said first box frame support member.

3. The modular boat lift cover of claim 1, further comprising a splice disposed between a second end of said first box frame support member and a first end of said second box frame support member at a box frame support component juncture, said splice reinforcing and providing additional strength to said box frame support component juncture.

4. The modular boat lift cover of claim 1, wherein said gable assembly is securely engageable with a canopy, said canopy being detachable from and reattachable to said modular boat lift cover, said canopy protecting said watercraft from sun and hurricane-level winds when said watercraft is at port.

5. The modular boat lift cover of claim 1, wherein said boat lift cover has a bowed configuration, at least a portion of a perimeter of said boat lift cover being reinforced by a modular rigid support frame.

6. The modular boat lift cover of claim 1, wherein said boat lift cover is usable for both lake type and tidal lifts.

7. The modular boat lift cover of claim 1, wherein said modular boat lift cover serves as a building block for expanding said modular boat lift cover to adapt to a second watercraft.

8. A modular boat lift cover for a first watercraft, said modular boat lift cover comprising:
- a gable assembly including;
  - a plurality of peak fittings positioned on a peak of said gable assembly;
  - a plurality of support tubes securely supporting said plurality of peak fittings, said plurality of support tubes securely engaging at least one of said plurality of peak fittings;
  - a first and a second box frame support member each supporting at least one of said plurality of support tubes, said first and said second box frame support member being horizontally disposed, said plurality of support tubes being positionable inside said first or second box frame support member during shipping; and
  - an end cap securely nestable inside a first end of said first box frame support member, said end cap preventing debris from entering said first end of said first box frame support member when said end cap is disposed relative to said first end of said first box frame support member; and
- a cantilever bracing said gable assembly to a piling, said piling being a substantially vertical support disposed between a support structure and a waterway bottom.

9. The modular boat lift cover of claim 8, further comprising a splice disposed between a second end of said first box frame support member and a first end of said second box frame support member at a box frame support component juncture, said splice reinforcing and providing additional strength to said box frame support component juncture.

10. The modular boat lift cover of claim 8, wherein said gable assembly is securely engageable with a canopy, said canopy being detachable from and reattachable to said modular boat lift cover, said canopy protecting said watercraft from sun and hurricane-level winds when said watercraft is at port.

11. The modular boat lift cover of claim 8, wherein said boat lift cover has a bowed configuration, at least a portion of a perimeter of said boat lift cover being reinforced by a modular rigid support frame.

12. The modular boat lift cover of claim 8, wherein said boat lift cover is usable for both lake type and tidal lifts.

13. The modular boat lift cover of claim 8, wherein said modular boat lift cover serves as a building block for expanding said modular boat lift cover to adapt to a second watercraft.

14. A modular boat lift cover for a first watercraft, said modular boat lift cover comprising:

a gable assembly including;

a plurality of peak fittings positioned on a peak of said gable assembly;

a plurality of support tubes securely supporting said plurality of peak fittings, said plurality of support tubes securely engaging at least one of said plurality of peak fittings;

a first and a second box frame support member each supporting at least one of said plurality of support tubes, said first and said second box frame support member being horizontally disposed, said plurality of support tubes being positionable inside said first or second box frame support member during shipping; and a splice disposed between a second end of said first box frame support member and a first end of said second box frame support member at a box frame support component juncture, said splice reinforcing and providing additional strength to said box frame support component juncture; and a cantilever bracing said gable assembly to a piling, said piling being a substantially vertical support disposed between a support structure and a waterway bottom.

15. The modular boat lift cover of claim 14, further comprising an end cap securely disposed nestably inside a first end of said first box frame support member, said end cap preventing debris from entering said first end of said first box frame support member when said end cap is disposed relative to said first end of said first box frame support member.

16. The modular boat lift cover of claim 14, wherein said gable assembly is securely engageable with a canopy, said canopy being detachable from and reattachable to said modular boat lift cover, said canopy protecting said watercraft from sun and hurricane-level winds when said watercraft is at port.

17. The modular boat lift cover of claim 14, wherein said boat lift cover has a bowed configuration, at least a portion of a perimeter of said boat lift cover being reinforced by a modular rigid support frame.

18. The modular boat lift cover of claim 14, wherein said boat lift cover is usable for both lake type and tidal lifts.

19. The modular boat lift cover of claim 14, wherein said modular boat lift cover serves as a building block for expanding said modular boat lift cover to adapt to a second watercraft.

20. The modular boat lift cover of claim 14, wherein said support tubes have a bowed configuration, being initially linear in shape but becoming bowed under stress, one of said plurality of bowed tubes being securely attachable to one of said plurality of peak fittings.

* * * * *